United States Patent [19]

Green, deceased et al.

[11] Patent Number: 4,698,134

[45] Date of Patent: Oct. 6, 1987

[54] METHOD FOR CLEANING PAPERMAKING FABRICS

[75] Inventors: Marshall S. Green, deceased, late of Waterbury Centre, Vt., by Elisabeth Green, administrator; Jean-Paul Boisvert, Grand'Mere, Canada

[73] Assignee: Consolidated-Bathurst, Inc., Montreal, Canada

[21] Appl. No.: 789,432

[22] Filed: Oct. 21, 1985

Related U.S. Application Data

[63] Continuation of Ser. No. 555,066, Nov. 25, 1983, abandoned.

[51] Int. Cl.[4] ..... O21F 1/32

[52] U.S. Cl. ..... 162/199; 162/275

[58] Field of Search ..... 162/199, 274, 275, 279; 134/15; 239/DIG. 7

[56] References Cited

U.S. PATENT DOCUMENTS

| | | | |
|---|---|---|---|
| 2,052,869 | 9/1936 | Coanda | 239/DIG. 7 |
| 3,279,977 | 10/1966 | Cirrito | 162/276 |
| 3,347,740 | 10/1967 | Goumeniouk | 162/274 |
| 4,116,762 | 1/1978 | Gardiner | 162/275 |
| 4,270,978 | 6/1981 | Fioravanti | 162/275 |
| 4,274,210 | 6/1981 | Stengard | 239/DIG. 7 |

OTHER PUBLICATIONS

Reba, "Applications of the Coanda Effect" Scientific American, Jun. 1966, pp. 84–91.

*Primary Examiner*—S. Leon Bashore
*Assistant Examiner*—K. M. Hastings
*Attorney, Agent, or Firm*—Robert J. Schaap; Eric Fincham

[57] ABSTRACT

There is taught a method and apparatus for the removal of foreign material and fluid from a fabric such as a press felt in a paper making machine, wherein a jet of gaseous material is directed at a surface of the felt without penetrating the felt to create a low pressure area to remove the fluid and foreign material within the fabric.

8 Claims, 7 Drawing Figures

METHOD FOR CLEANING PAPERMAKING FABRICS

This is a continuation of application Ser. No. 555,066 filed Nov. 25, 1983, now abandoned.

This invention relates to a method and apparatus for removing foreign material and fluid from a permeable fabric.

In the pulp and paper industry, the cleaning of papermaking felts and in particular press felts, has always been important for the efficient operation of paper machines. As the speed of the machines has increased over the years and with the increasing costs of the factors of production such as energy, it has become imperative that more efficient ways to clean, condition and dewater the felts used in the press section of the paper machine be found.

Presently, two methods are employed for the cleaning of the felts, both methods working in conjunction with water showers which spray water on the felts to loosen any material therein. In the first method, the felt is passed over a stationary suction box at which time the loosened dirt and water is sucked out of the felt. In a second method, the felt is passed through a ringer or squeeze press; the rolls comprising the press or ringer may or may not have a suction box incorporated therein.

In the method utilizing the stationary suction box, the felt is essentially dragged across the face of the box and due to the friction involved, a fair amount of energy is consumed by the motors which drive the felts and more energy is also consumed to provide the necessary vacuum. As will be appreciated, the wear on the felt and suction box covers is also substantial. The method utilizing the ringer or squeeze press is more energy efficient due to the rotating aspect of the press/suction rolls; however, the equipment required is more elaborate and expensive and the pressing action has been known to decrease the effectiveness of the felt.

It is therefore an object of the present invention to provide a method for the removal of foreign material and fluid from a permeable fabric which is both relatively efficient and does not require a high energy expenditure.

It is a further object of the present invention to provide a method and apparatus for a felt dewatering and conditioning system for the pulp and paper industry which will efficiently remove foreign material and water and therefore lead to dryer paper leaving the press section of the paper machine which in turn will reduce the energy required to further dry the paper.

According to one aspect of the present invention, there is provided a method of removing a fluid from a permeable fabric which includes the steps of directing a jet of a gaseous material at the fabric and controlling the velocity of the gaseous material such that it does not penetrate the fabric while creating an area of low pressure sufficient to remove at least a portion of the fluid within the fabric.

There is also provided an apparatus for removing fluid from a fluid containing permeable fabric comprising means to support the fabric in a desired position, gas supply means, jet means which are connected to the gas supply means and which are operative to direct a jet of pressurized gas at the fabric, and control means for controlling the velocity of the gas jet such that a substantial portion of the gaseous material does not penetrate the permeable fabric while creating an area of low pressure which is sufficient to remove at least a portion of the fluid from within the fabric.

In greater detail, the method and apparatus of the present invention are intended for use with a fluid containing fabric wherein it is desirable to remove at least a portion of the fluid from the fabric. The types of fabric with which the present invention can be used are numerous; although one of the prime applications is considered to be in the dewatering/conditioning of felt used in paper-making, other permeable fabrics may also have a desired material removed utilizing the method and apparatus of the invention. It suffices to say that the fabric is permeable and has a certain porosity in order that it contain the fluid which is to be removed. Similarly, although the invention may primarily find use in removal of a liquid from a liquid containing fabric, it may be desirable to remove a gaseous material from a fabric utilizing the present invention. Commercial possibilities are numerous including operations such as the dry cleaning of fabrics.

The present invention operates by directing a jet of gas at an angle to a supported fabric such that the gas impinges on the fabric and creates a zone of low pressure whereby the fluid/material will flow out of the fabric on at least one side of the jet. The term "low pressure" refers to a pressure which is less than the pressure existing within the fabric; this normal pressure will usually be atmospheric pressure In the practice of the present invention, the velocity of the jet of gaseous material is adjusted such that it does not flow through the fabric to escape on the other side; instead the major portion of the gas does not flow through but rather creates the desired effect by not passing through to the opposite side of the fabric. Naturally, the particular velocity employed in any particular situation will depend upon the porosity of the fabric, the loading of the fabric, the gaseous material, and other known factors. Further factors which have a relationship will be the distance between the gas jet (nozzle) and the fabric; the width of the gas jet, the velocity of the gaseous material, the location of that part of the surface of the fabric under the influence of the gaseous material, the velocity at which the fabric and air jet may be moving with respect to each other, etc.

The gas employed may be any which is suitable for the particular application. In many applications, and in particular where one is concerned with the conditioning of felts as employed in the paper-making industry, air is a suitable material.

The nozzle of the gas jet may take on many different configurations and indeed, the nozzle may merely comprise a slit which has been cut in a section of pipe. A plurality of nozzles may be employed to cover the entire width of the fabric. As aforementioned, one simple embodiment will utilize a pipe in which a plurality of slits or one long slit have been cut to cover the entire width of the felt. Gas may be fed to the pipe from one or both ends or at intervals so as to minimize any pressure drop.

In the pulp and paper industry, the felt has a liquid sprayed onto the felt which assists in loosening foreign material therein. Subsequently, the gas is directed at the felt to remove the fluid and foreign material contained therein. It has been found the removal of the foreign material is extremely efficient with the practice of the present invention and thus leads to a felt having a better performance.

Having thus generally described the invention, reference will be made to the accompanying drawings illustrating embodiments thereof and in which.

Figure 1:
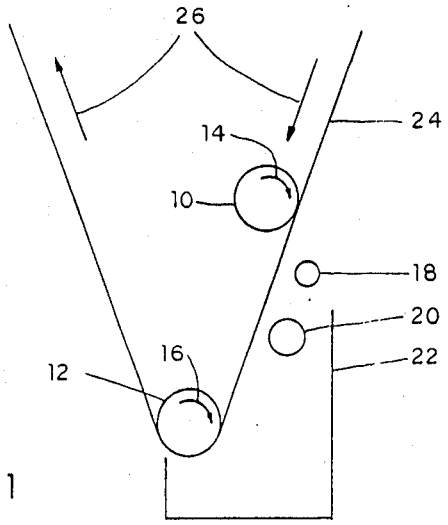
FIG. 1 is a side elevational view of a dewatering arrangement.

FIG. 1 is an elevational view of an arrangement involved in applying the present invention to the removal of foreign material/fluid from a fabric and in particular, to the conditioning of a wet press felt on a paper machine. There are many overall wet press arrangemnts; FIG. 1 illustrates a small section of the overall system to show where the present invention can be fitted in. As shown, a descending section of the felt run may be chosen as this may be more convenient for collecting and disposing of the water extracted by the device; design considerations may, however, make a horizontal run more feasible.

Referring to FIG. 1, a portion of a wet press felt run is illustrated. A pair of felt guide rolls 10 and 12 are provided, felt guide rolls 10 and 12 being journalled on suitable supports (not shown) and rotating as shown by arrows 14 and 16 respectively. A shower pipe 18 is provided, shower pipe 18 being connected to a source (not shown) of water or other suitable fluid for spraying the felt to loosen any clogging foreign material. Reference numeral 20 generally designates a slotted air-jet nozzle or blow pipe as will be discussed in greater detail hereinbelow; a tray 22 is provided to catch the water extracted from the felt and thrown aside by the air jet. The wet press felt 24 is advanced in the direction indicated by arrows 26 over felt guide rolls 10 and 12. It is inherent that the surface of the felt closest to shower 18 and pipe 20 is that surface which has been in contact with the paper web.

Figure 2:
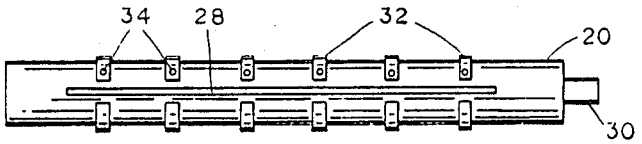
FIG. 2 is a detail view of one embodiment of a nozzle.

FIG. 2 illustrates the blow nozzle 20 in more detail. Referring to FIG. 2, nozzle 20 is a section of pipe in which a narrow slit 28 has been made; the length of the slit is approximately the width of the wet felt and the width of the slit will depend on several factors which will be discussed below. A connection 30 is provided to which a gas supply is attached; depending on the length and diameter of the pipe, it may be desirable to feed air into the pipe from both ends (as well as at intermediate points) so as to minimize any pressure drop and an uneven air jet; alternatively or in conjunction with this, the pipe may be tapered. A series of circular clamps 32 are provided which, if necessary, can be used to adjust the local width of the air slot and so maintain an even longitudinal velocity profile for the air jet as it passes through slot 28 (this adjustment can be made by a small set screw 34 set in the wall of the clamp with the end of screw 34 bearing against the outside wall of the pipe).

Figure 3:
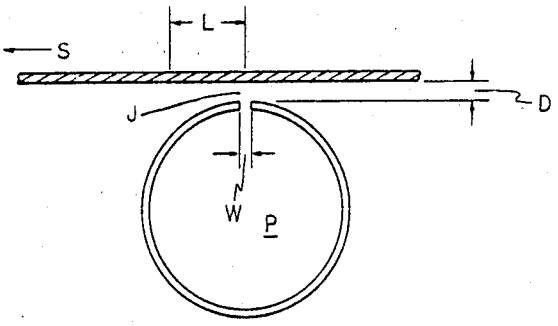
FIG. 3 is a detail view of a portion of the dewatering arrangement of FIG. 1.
Figure 4:
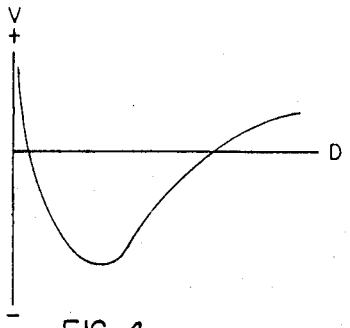
FIG. 4 is a graph illustrating relationships between the distance of the nozzle from the fabric and the pressure at the fabric surface.
Figure 5:
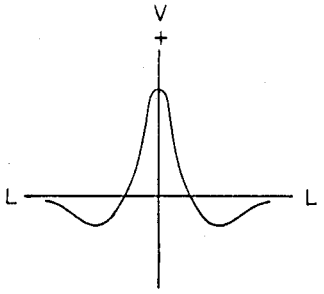
FIG. 5 illustrates the relationship between the pressure and its effect on a particular segment of the fabric.

FIG. 3 illustrates some of the parameters to be considered and the relationships between them and the pressure or vacuum developed at the surface of the fabric where the jet impinges. FIG. 4 shows the relationship between the distance D and the air pressure condition at the surface of the fabric where the jet impinges. FIG. 5 shows the relationship between the distance L and the air pressures at that point.

As seen in FIG. 3, W is the width of the slot through which the air passes to form the air jet having a velocity J whose energy source is the pressure P of the air in the pipe nozzle. The distance of slot or jet exit from the fabric is designated by D, and L is the location or distance of that part of the surface of the fabric under the influence of the air jet which is being examined; the fabric is moving relative to jet 20 at a velocity S.

The relationship shown in FIG. 4 does not give any absolute values as these will vary with the jet velocity J (and to some extent the geometry of the jet) and the location of the surface being examined i.e., the distance L from the center of the slit or the jet to that part of the surface of the fabric being examined; However, it clearly shows that for a given J there is a specific D where the pressure V in terms of vacuum is maximum and it is at this point where maximum efficiency is achieved. In general the value of D for optimum V will change very little as J is varied. It is not necessary to locate and maintain the jet exit at this specific value of D, for as long as the jet is in the vicinity of this value and the felt is free to move slightly, the felt will automatically position itself at the specific distance as the forces of pressure and vacuum balance each other out. The value of D for optimum vacuum is usually in the order of 2 mm. (0.079") or less.

At this specific D for maximum V, applicant found that V varied as L changed. In fact, for the orientation shown in FIG. 3 where the air jet is at right angles to the surface, directly at the jet there will be a pressure zone, and on either side of this there will be a vacuum zone of equally decreasing intensity as the value of L increases; this is shown in FIG. 5. As illustrated, the magnitude of the vacuum peak will be roughly in the order of one-half the pressure peak; and the pressure peak will be close to P the pressure in the pipe. The vacuum peak will occur when L is approximately 2.5 mm. In some cases it will be found preferable to operate the jet at right angles to the fabrics; however, for other cases, it might be desirable to operate the jet at various angles to the fabric. For example, where the fabric is moving past the air jet at a relatively high velocity it was found desirable to turn the jet slightly towards the oncoming felt (i.e. angled the jet against the felt travel); this tended to increase the suction effect.

Generally, the higher the value of J the higher the value of V; and since V is much more sensitive to J than to the volume of air involved, it therefore is generally more desirable economically to operate the air jet with a lower rather than a higher volume of air and to obtain the high velocities required for optimum V by using narrow slits in the blow nozzle. While there is some practical relationship between the velocity of the fabric S and the jet velocity J it is only significant when S is fairly large; that is, while the vacuum in the vicinity of the fabric surface is independent of the velocity of the fabric, it is obvious that if fabric is moving very quickly the vacuum condition will have little time to have any effect on the fabric and to extract the water embedded in the pores of the fabric. The relationship between P the pressure of air in the pipe and J is of course a fixed one, being influenced only by the co-efficient of velocity (which varies with the type of orifice and other conditions of operation). As can be seen from the above discussion, the values that can be assigned to the above parameters will depend on the use of the invention and the economics involved. As mentioned above the fabric or felt will automatically position itself the required distance from the jet. Nevertheless, to prevent gross vibration or flapping of the felt, guide roll 10 (FIG. 1) which is normally not present in conventional felt runs, will avoid problems of that sort; if necessary under certain conditions, further guide rolls can be added.

Another important element of the invention that has a bearing on the efficiency of its operation, is the area/-surface/volume just under the gas jet as it rebounds from the fabric and begins to flow parallel to it. One could, for example, visualize a jet issuing from a nozzle buried in a flat surface over which the fabric is passing; such an arrangement has generally not been found satisfactory depending on the width of the flat surface. This is partially because the mixture of gas and fluid (extracted from the fabric), in order to escape, has to pass through the thin volume delineated by the fabric and the flat surface of the nozzle ( the height of this volume being substantially constant at 2 mm.). A curved surface has been found to be very satisfactory as it allows the gas (air) to break away from the fabric and follow the curved surface. An optimum shape for this surface will depend on such variables as jet velocity, volume, etc. From a construction point of view, a circular curvature is very satisfactory as an ordinary pipe can be used for the blow nozzle. Following the same reasoning, a smaller diameter pipe nozzle is preferable to a larger one; therefore to keep the diameter as small as possible and to minimize the pressure drop of the gas flowing in the pipe it is preferable to feed gas into the pipe from several inlets where necessary. At the other extreme one could use a nozzle where the sides of an elongated orifice would be vertical and straight, i.e., perpendicular to the fabric; for intermediary designs the sides would be straight and tapered at some chosen angle to the surface of the fabric.

In applications involving the conditioning of wet press felts as shown in FIG. 1, the following was observed after the blow nozzle 20 was properly positioned and the air jet 20 and water spray jet 18 were operated; the water shower jet tended to penetrate the felt, loosen the foreign material therein, and saturate the felt surface with water, the air jet in turn sucked from the felt substantial quantities of water (and foreign material) and this was followed by the blow stage action of the jet which in turn was followed by a second sucking action (see FIG. 5). All this resulted in the water (and foreign material) in the form of a heavy spray being flung away from the felt surface to be collected in tray 22 and carried away. This rapid and sudden vacuum, and blow and vacuum action of the air jet as it split into two streams (in comparison to the single suction action of a conventional vacuum suction box) tended to leave the felt surface in more absorptive condition for removing water from the paper in the wet presses. The felt surface hairs, for example, showed a marked tendency to stand out rather than to lie flat and matted. One substantial advantage of the device is in the substantial drop in energy required to produce this cleaning and conditioning action; for example a 100" wide felt condition of the conventional vacuum type drawing 10" of Hg at 2000 cfm would require approximately 100 HP, whereas the present blow nozzle would perform the same operation for substantially less energy expenditure. In addition, since the felt is riding on a cushion of air, little or no energy is used in moving the felt through the suction zone, whereas, much friction is present and energy used up in carrying the felt over a conventional suction box. Also since there is no contact with any solid surfaces, there is little chance for any pitch on the felt surface to be smeared to be smeared across and into the surface of the felt, decreasing its water absorption properties.

Figure 6:
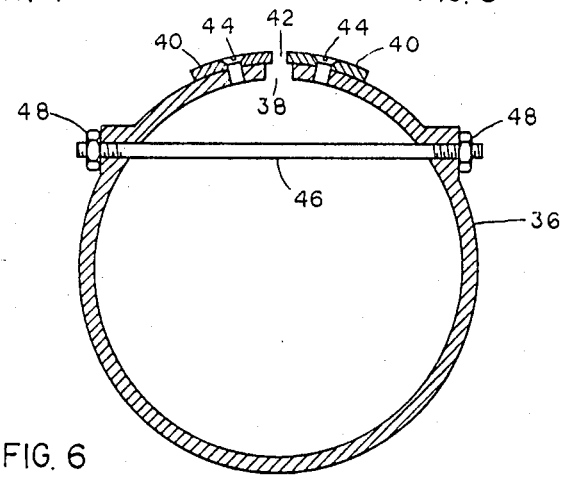
FIG. 6 is a cross-sectional view of a nozzle arrangement.

FIG. 2 illustrates a construction of the blow nozzle where a slit was made in a pipe in its longitudinal direction. Since this could be a difficult operation in a long blow pipe, and also where the slit might vibrate and operate as a reed, FIG. 6 illustrates a further method of construction where a cross-sectional view of a blow nozzle is shown. A section of pipe 36 has a rought slot 38 cut therein, the width of which is several times wider than the final width of the jet orifice and at least as long; this area of the pipe nozzle then acts as a support for two strips of material 40 which lie on the outside surface of the pipe nozzle to define the jet orifice 42. These strips may be made out of any convenient material preferably, that which will define a uniform and sharp orifice as well as be wear resistant should any erosive material be dragged across the orifice by the felt, e.g., high density polyethylene; stainless steel. These orifice strips may be preformed to fit the curvature of the pipe or be flexible enough to conform; they may be attached by sets of counter-sunk screws 44 to pipe 36; by using slotted holes for the screws these strips could be made adjustable. In situations where the jet orifice 42 will be long, it may be necessary to stabilize the jet width and the mechanical integrity of the pipe by using tension rods 46 running across the pipe at suitable intervals along its length. Threads and nuts (gaskets) 48 could be provided at the ends so the tension (and orifice profile) could be adjusted. For the overall support of the blow nozzle and to keep it straight and true, various techniques are possible and known in the art. One particular method is described below in regard to providing a spray/mist collecting device. For certain situations, such as to provide forslot non-uniformity, it may even be desirable to arrange for the blow nozzle to oscillate back and forth under the felt in the transverse direction.

Figure 7:
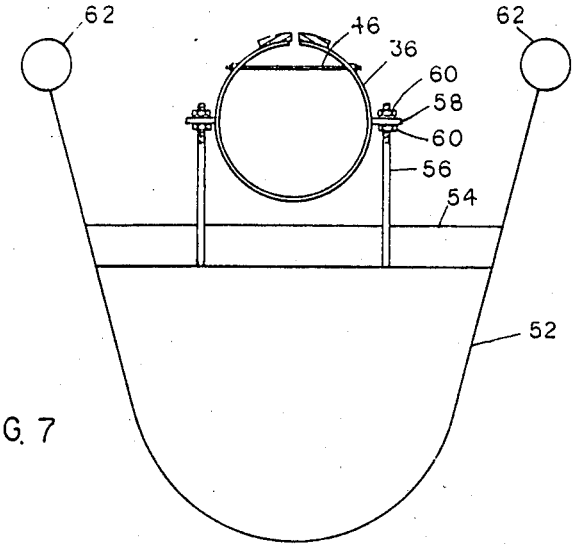
FIG. 7 is a side elevational view of an arrangement to support the nozzle and contain the moisture removed from the fabric.

It was also found that at high jet velocities, the water removed from the felt tended to turn into a very fine mist which in certain applications might be found to be undesirable should it be allowed to permeate the area. FIG. 7 illustrates an apparatus to contain this mist and spray and in addition provide a method of supporting the pipe and adjusting it so that it will remain level for its full length. This is, of course, a very important feature for a long blow pipe which would tend to sage if supported only at the two ends. While independent supports along its legnth may be possible in certain applications, it is generally preferable to provide one having rigid cross-sectional characteristics.

Referring to FIG. 7, 36 is a blow nozzle (the details of which are illustrated in FIG. 6) and 52 is a trough-like container to keep the mist and spray from permeating the area. Retaining bracket(s) 54 are spaced at suitable intervals along the length of container 52 to give further rigidity to container 52. Rods 56 are of nuts, screw-threadedly engaged with an opposite end of rod 56 in conjunction with bracket 58, adds rigidity and support to blow nozzle 36. Small diameter rods or pipes 62 are provided over which the fabric will run the tops of which will be essentially level with the top of nozzle 36. Other sealing shapes/surface can be used; however, since there can be contact with the fabric any sharp edges that may touch the fabric should be avoided. The trough will be sealed at both ends using conventional techniques and may be subjected to either a slight gas pressure or a slight vacuum depending on the situation. As was mentioned, since it is generally desirable to keep the diameter of nozzle 36 on the small side, if nozzle 36 is sufficiently long to incur serious pressure drop losses, the lower part of the trough can be used for a larger diameter gas supply line (or series of lines) with which to furnish nozzle 36 with the required gas. To avoid too much mist leaking past the various sealing areas the mist in the trough can be continuously removed with an inexpensive fan exhauster; liquid in the bottom of the trough can be removed through a suitable trap. Where practical, after de-misting, the gas (air) can be recycled to the pipe nozzle through a blower which will maintain the required pressure in the nozzle. The following is an example of the above-described embodiments to a paper-making wet felt.

A pipe nozzle approximately 16 inches long similar to the one illustrated in FIG. 2 was used. The air pressure was kept at 15 psig and this corresponds to an air-jet velocity (J) of approximately 1360 fps. The width of the orifice slot (W) was 0.010 inches. (See FIG. 3). D was 2 mm (0.079 inch).

The invention was placed against a conventional paper-making wet felt after it had been subjected to the action of a conventional felt conditioner (of the stationary suction box type) installed on a modern newsprint machine. By measuring the moisture in the felt before and after its passage over the orifice slot of the present invention it was found that the apparatus had removed between 10–20 grams of water per square meter and since no attempt had yet been made to optimize its operation, it was evident that the dewatering efficiency of the present invention was greater than that representing prior art equipment. Moreover, the cleanliness of the felt has a great effect (for a given felt) on a sheet dryness. Consequently, in the above test, samples of the water extracted from the felt were tested for % solids and for the nature of the material extracted. These tests showed the % solids to be 0.65 and the material to be mainly groundwood and sulphite pulp debris and fines with traces of felt hairs. Thus the cleaning efficiency of the present invention was also found to be greater than that of prior art equipment.

It is also obvious from the present disclosure that for the invention to work the gas jet or at least a substantial portion of the gas should not be able to flow through the fabric to escape on the opposite side. Thus, to accommodate the porosity of the fabric one merely has reduced the jet velocity to a point where it d.oes not flow through, but still has sufficient energy to create the desired vacuum/sucking effect. A further embodiment of the invention could involve a combination of a straight blowing operation on one side of the fabric along with the present invention on the other side—i.e., the controlled low pressure would be used on one side of the fabric and simultaneously a jet of gas would be allowed to impinge on the other side of the fabric directly opposite the gas jet of the present invention and penetrate the fabric, so that by controlling the force (and location) of the two jets, one jet (that opposite the one that will create a low pressure) would urge the fluid to the other side where the low pressure effect would complete the extraction of the fluid and convert it into a spray/mist. Similarly, if the fabric is fairly thick gas jets of the present invention could be used to create a low pressure effect on both sides of the fabric at the same time.

Because of the relatively high dewater/cleaning efficiency of the present invention, it may not be necessary to operate the device continuously. Thus in the case of a full felt width nozzle the effect may be used intermittently on some optimum cycle. Alternatively, a short nozzle could be made to scan or travel across the width of the felt inside a collecting pipe at some optimum speed/cycle or the slot itself could be full width and a short section of the air jet itself could be made to scan the felt. Since the use of one long slit weakens the pipe (nozzle), a plurality of slits (i.e. with a stiffening space between slits) can be used and the pipe can be made to oscillate/travel transversely back and forth sufficiently so that the travel will allow the jet to cover the fabric under the unslitted space. Besides dewatering/cleaning wet felt fabrics on a paper machine, one could also utilize the invention to clean wet end wire fabrics also utilized on paper machines thereby replacing messy high pressure oscillating needles or fan showers. Other applications include wire fabrics on twin wire formers and the cleaning of drier felts. It will be understood that the above described embodiments are for purposes of illustration only and that changes and modifications may be made thereto without departing from the spirit and scope of the invention.

We claim:

1. A method of removing a fluid from a fluid containing permeable fabric having opposed major surfaces, one of the major surfaces having been in contact with a paper web for dewatering of the web, the method comprising the steps of supporting said fabric, directing a jet of gaseous material at said one major surface having been in contact with the paper web, and controlling the velocity of said gaseous material in response toat least the porosity of the fabric and loading of the fabric and distance between the source of jet of gaseous material with respect to the fabric, such that a major portion of said gaseous material does not pass through the permeable fabric and said jet of gaseous material creates an area of low pressure adjacent to and on the same fabric surface at which said gaseous material is directed, thereby causing the removal of a portion of the fluid within the fabric from the same side of said fabric at which said gaseous material is directed.

2. The method of claim 1 wherein the step of supporting said fabric comprises the step of supporting the fabric at points on either side of said jet of gaseous material while allowing said fabric freedom of movement where said jet of gaseous material is directed thereon.

3. The method of claim 2 including the step of directing a jet of gaseous material at both of said major surfaces.

4. The method of claim 1 wherein said fabric and said jet of gaseous material are moving relative to one another.

5. A method of removing moisture and solids from a paper machine press section felt which has opposed major surfaces, at least one of the major surfaces having been in contact with a paper web for dewatering of the web, said method comprising the steps of supporting said felt, spraying a liquid on said one major surface of said felt having been in contact with said paper web, directing a jet of gaseous material at said one major surface of said felt having been in contact with said paper web, and controlling the velocity of said gaseous material in response to at least the porosity of the fabric and loading of the fabric and distance between the source of jet of gaseous material with respect to the fabric, such that the major portion of said gaseous material does not penetrate through said felt and creates an area of low pressure adjacent said jet and removes at least a portion of the liquid and solids contained within said felt from the same side of said felt at which said gaseous material is directed.

6. The method of claim 5 wherein said felt is supported on either side of said jet of gaseous material while being free to more closer or further from said jet, said jet being space from said felt at a distance of about 2 mm.

7. The method of claim 6 wherein said felt is moving relative to said gaseous material.

8. The method of claim 6 wherein said jet of gaseous material is angled slightly from the perpendicular at a major planar surface of said felt.

* * * * *